US007835915B2

(12) United States Patent
Kim et al.

(10) Patent No.: US 7,835,915 B2
(45) Date of Patent: Nov. 16, 2010

(54) SCALABLE STEREO AUDIO CODING/DECODING METHOD AND APPARATUS

(75) Inventors: Jung-hoe Kim, Seoul (KR); Sang-wook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1047 days.

(21) Appl. No.: 10/737,957

(22) Filed: Dec. 18, 2003

(65) Prior Publication Data

US 2004/0181395 A1 Sep. 16, 2004

(30) Foreign Application Priority Data

Dec. 18, 2002 (KR) ..... 10-2002-0081074

(51) Int. Cl.
*G10L 19/00* (2006.01)
*G10L 21/00* (2006.01)

(52) U.S. Cl. ..... 704/500; 704/501

(58) Field of Classification Search ..... None
See application file for complete search history.

(56) References Cited

U.S. PATENT DOCUMENTS 6,029,126 A 2/2000 Malvar
6,122,618 A * 9/2000 Park ..... 704/500
6,182,031 B1 * 1/2001 Kidder et al. ..... 704/205
6,349,284 B1 * 2/2002 Park et al. ..... 704/500
6,351,730 B2 2/2002 Chen
6,370,507 B1 4/2002 Grill et al.
6,529,604 B1 * 3/2003 Park et al. ..... 381/22

FOREIGN PATENT DOCUMENTS

EP 0918407 * 5/1999
KR P1998-076475 11/1998

OTHER PUBLICATIONS

Grill et al, "Scalable Joint Stereo Coding", 105th AES Convention, Sep. 1998.*

* cited by examiner

*Primary Examiner*—David R Hudspeth
*Assistant Examiner*—Samuel Neway
(74) *Attorney, Agent, or Firm*—Staas & Halsey LLP

(57) ABSTRACT

Scalable stereo audio coding and decoding method and apparatus are provided. The scalable stereo audio coding method includes transforming a first channel and a second channel audio samples; quantizing the transformed first channel and a second channel audio samples; and coding the quantized first channel audio samples up to a predetermined transition layer and then interleavingly coding the quantized first and second channel audio samples with increasing a layer index from a layer succeeding the transition layer, until coding for a predetermined plurality of layers is finished.

22 Claims, 6 Drawing Sheets

SCALABLE STEREO AUDIO CODING/DECODING METHOD AND APPARATUS

BACKGROUND OF THE INVENTION

This application claims the priority of Korean Patent Application No. 2002-81074, filed on Dec. 18, 2002, in the Korean Intellectual Property Office, the disclosure of which is incorporated herein in its entirety by reference.

FIELD OF THE INVENTION

The present invention relates to audio data coding and decoding, and more particularly, to a method and apparatus for coding audio data so that a coded stereo audio bitstream has a scalable bitrate, and a method and apparatus for decoding the coded stereo audio bitstream.

DESCRIPTION OF THE RELATED ART

With the recent developments of digital signal processing technology, audio signals are usually stored and reproduced in digital data form. A digital audio storing/reproducing apparatus converts an analog audio signal into a digital signal referred to as pulse code modulation (PCM) audio data by sampling and quantizing the analog audio signal, stores the PCM audio data on an information storage medium such as a CD or a DVD, and allows a user to reproduce it at any time. Such a digital storing/reproducing method remarkably increases sound quality and remarkably decreases degradation of sound quality due to a long storage duration, as compared to an analog storing/reproducing method using, for example, a long-play (LP) record or a magnetic tape. However, the digital storing/reproducing method is disadvantageous in that storage and transmission cannot be efficiently performed due to a large size of digital data.

To overcome this problem, various methods of compressing a digital audio signal have been used. Moving Picture Experts Group (MPEG)/audio that has been standardized by International Standard Organization (ISO) and AC-2/AC-3 developed by Dolby employ methods of reducing the amount of data using a human psychoacoustic model, so that the amount of data can be efficiently reduced regardless of the characteristics of a signal. In other words, the MPEG/audio standard and the AC-2/AC-3 method provide sound quality at almost the same level as CD sound quality at a bit rate of 64-384 Kbps, that is, ⅙-⅛ of a bit rate used by the conventional digital coding method.

However, since these methods include performing quantization and coding after selecting an optimal state for a fixed bit rate, data transmitted through a network may be broken when a transmission bandwidth is decreased due to a poor network state, and furthermore, a service may not be provided to a user thereafter. In addition, when data is converted into a bitstream having a smaller size to be suitable to a mobile device with a limited storage capacity, re-encoding is required to reduce the size of data, which increases the amount of calculation.

To overcome this problem, the applicant of the present invention filed Korean Patent Application No. 97-61298 on Nov. 19, 1997, entitled "Scalable Audio Coding/Decoding Method and Apparatus Using Bit-Sliced Arithmetic Coding (BSAC)," registered on Apr. 17, 2000, with Registration No. 261253 in the Korean Intellectual Property Office. According to the BSAC, a bitstream that has been coded at a high bit rate can be converted into a bitstream having a low bit rate, and data can be reproduced using only a part of the bitstream. As a result, even when a network is overloaded, a decoder has poor performance, or a user requests a low bit rate, a service can be provided to the user at a certain level of sound quality using only a part of a bitstream although performance may be degraded proportionally to a decreased bit rate. However, since the BSAC technique uses a modified discrete cosine transform (MDCT) for transformation of an audio signal, audio quality in a lower layer may severely deteriorate.

Meanwhile, a technique using quantization to adjust a bit rate is disclosed in U.S. Pat. No. 6,351,730. Since this technique uses a psychoacoustic model, sound quality is satisfactory in a lower layer but is degraded in a higher layer due to an excessive overhead. Other audio coding/decoding techniques are disclosed in U.S. Pat. Nos. 6,182,031, 6,370,507, and 6,029,126. These techniques use down sampling and provide satisfactory sound quality in a lower layer, but they are disadvantageous in that an interval between scalable bit rates is large or a large amount of calculation is required. As a result, they are difficult to be used for fine grain scalability (FGS).

Such a scalable audio coding apparatus codes most of audio data into a stereo signal having a sampling rate of 44.1 or 48 KHz to provide CD sound quality and uses a hierarchy structure in which a frequency band expands when a layer increases. In such a hierarchy structure, a stereo signal is coded alternately for left and right channels. In this situation, since sound quality of a stereo signal is degraded in a lower layer, more noise is perceived when the stereo signal is coded than when a mono signal is coded.

SUMMARY OF THE INVENTION

The present invention provides a stereo audio coding and decoding method and apparatus, which increase sound quality in a lower layer while providing fine grain scalability (FGS).

According to an aspect of the present invention, there is provided a scalable stereo audio coding method transforming a first channel and a second channel audio samples; quantizing the transformed first channel and a second channel audio samples; and coding the quantized first channel audio samples up to a predetermined transition layer and then interleavingly coding the quantized first and second channel audio samples with increasing a layer index from a layer succeeding the transition layer, until coding for a predetermined plurality of layers is finished.

According to another aspect of the present invention, there is provided a scalable stereo audio coding apparatus comprising: a psychoacoustic unit providing information on a psychoacoustic model; a transformation unit transforming a first channel and a second channel audio samples based on the information on a psychoacoustic model; a quantizer quantizing the transformed first channel and a second channel audio samples; and a bit packing unit coding the quantized first channel audio samples up to a predetermined transition layer and then interleavingly coding the quantized first and second channel audio samples with increasing a layer index from a layer succeeding the transition layer, until coding for a predetermined plurality of layers is finished.

According to still another aspect of the present invention, there is provided a scalable stereo audio decoding method comprising: decoding a first channel audio samples up to a predetermined transition layer and then interleavingly decoding the first and a second channel audio samples with increasing a layer index from a layer succeeding the transition layer, until decoding for a predetermined plurality of layers is finished and obtaining quantized samples of the first and the second channels; dequantizing the quantized samples of the first and the second channels; and inverse transforming the dequantized samples of the first and the second channels to obtain first and the second channel audio samples.

According to still another aspect of the present invention, there is provided a scalable stereo audio decoding apparatus comprising: a bit unpacking unit decoding a first channel audio samples up to a predetermined transition layer and then interleavingly decoding the first and a second channel audio samples with increasing a layer index from a layer succeeding the transition layer, until decoding for a predetermined plurality of layers is finished and obtaining quantized samples of the first and the second channels; dequantizer dequantizing the quantized samples of the first and the second channels; and inverse transformer inverse transforming the dequantized samples of the first and the second channels to obtain first and the second channel audio samples.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Hereinafter, preferred embodiments of the present invention will be described in detail with reference to the attached drawings.

Figure 1:
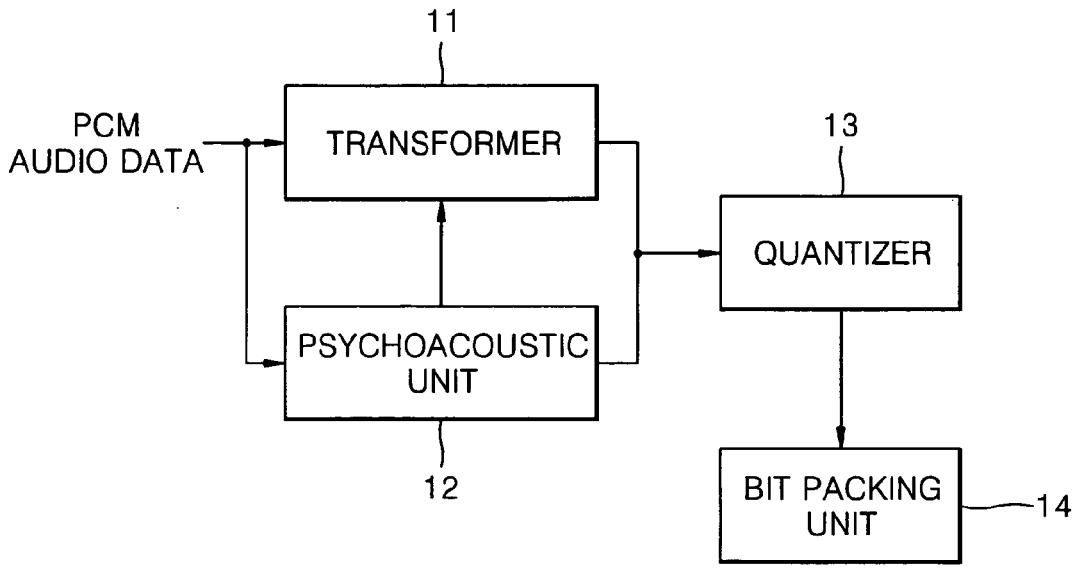
FIG. 1 is a block diagram of an audio coding apparatus according to an embodiment of the present invention.

FIG. 1 is a block diagram of an audio coding apparatus according to an embodiment of the present invention. The audio coding apparatus includes a transformer 11, a psychoacoustic unit 12, a quantizer 13, and a bit packing unit 14 to code audio data in a hierarchy structure so that a bit rate can be scaled.

Referring to FIG. 1, the transformer 11 receives pulse coded modulation (PCM) audio data in a time domain, that is, left audio samples and right audio samples obtained from two or more channels and converts them into a signal in a frequency domain according to information on a psychoacoustic model provided by the psychoacoustic unit 12. A difference between the characteristics of audio signals perceived by people is not large in the time domain. As for audio signals obtained through transformation in the frequency domain, the characteristics of audio signals that can be perceived by people are largely different from those of audio signals that cannot be perceived in each frequency band according to a human psychoacoustic model. Accordingly, compression efficiency can be increased by varying the number of bits allocated to each frequency band.

The phsychoacoustic unit 12 provides information on a phsychoacoustic model such as attack detection information to the transformer 11. In addition, the psychoacoustic unit 12 divides an audio signal transformed by the transformer 11 into signals in appropriate sub-bands, calculates a masking threshold for each sub-band using a masking phenomenon occurring due to interference between the signals in the sub-bands, and provides the calculated masking thresholds to the quantizer 13. In an embodiment of the present invention, the phsychoacoustic unit 12 calculates a masking threshold of a stereo component using binaural masking level depression (BMLD).

The quantizer 13 scalar quantizes audio signals in each sub-band based on corresponding scale factor information to make the magnitude of quantization noise in each sub-band less than a masking threshold provided by the phsychoacoustic unit 12 so that people cannot perceive the quantization noise, and outputs quantized samples. In otherwords, the quantizer 13 performs quantization using a Noise-to-Mask Ratio (NMR), that is, a ratio of a masking threshold calculated by the phsychoacoustic unit 12 to noise occurring in each sub-band, such that an NMR in the entire band does not exceed 0 dB. When the NMR does not exceed 0 dB, quantization noise is not heard by people.

The bit packing unit 14 codes quantized samples provided from the quantizer 13 by combining additional information of each layer with quantization information at a bit rate corresponding to the layer. Here, as the layer increases, mono components in a stereo signal are coded to a predetermined transition layer (hereinafter, referred to as ENHANCE_CHANNEL), and then stereo components in the stereo signal are hierarchically coded from a layer succeeding the ENHANCE_CHANNEL. A coded bitstream is packed in a layer architecture. Additional information includes quantization band information, coding band information, scale factor information, and coding model information with respect to each layer. Quantization band information is used to appropriately quantize an audio signal according to the frequency characteristics of the audio signal. When a frequency range is divided into a plurality of bands, and an appropriate scale factor is allocated to each of the bands, quantization band information indicates a quantization band corresponding to each layer. Accordingly, at least one quantization band belongs to each layer. Each quantization band is allocated a single scale factor. Coding band information is also used to appropriately quantize an audio signal according to the frequency characteristics of the audio signal. When a frequency range is divided into a plurality of bands, and an appropriate coding model is allocated to each of the bands, coding band information indicates a coding band corresponding to each layer. Quantization bands and coding bands are appropriately defined through experiments, and their scale factors and coding models are also appropriately allocated through experiments. Quantization band information and coding band information may be packed as header information and then transmitted to a decoding apparatus. Alternatively, quantization band information and coding band information may be coded and packed as additional information of each layer and then transmitted to a decoding apparatus. Alternatively, quantization band information and coding band information may not be transmitted to a decoding apparatus because the decoding apparatus stores the quantization band information and coding band information in advance.

More specifically, the bit packing unit 14 codes additional information including scale factor information and coding model information, which correspond to a base layer, and sequentially codes an audio signal from a most significant bit (MSB) to a least significant bit (LSB) and from a lower frequency component to a higher frequency component, based on the coding model information corresponding to the base layer. After coding is completed in the base layer, the same operation as described above is repeated in each layer above the base layer. In a stereo signal, mono components are coded to a predetermined transition point in channel 1, and stereo components after the transition point are interleavingly coded in channel 1 and channel 2. A bitstream coded through such an operation is packed to have a layer architecture according to predetermined syntax, for example, syntax used in Bit-Sliced Arithmetic Coding (BSAC). Here, transition point information may be expressed as a layer index, a scale factor band, or a coding band and included in header information of a frame or in additional information of each layer.

When the bit packing unit uses BSAC, a bitstream can be coded using a syntax shown in Table 1.

TABLE 1

| Syntax | No. of bits | Mnemonic |
|---|---|---|
| bsac_spectral_data(start_g, end_g, thr_snf, cur_snf) | | |
| { | | |
| if (layer_data_available( )) return; | | |
| for (snf=maxsnf; snf>thr_snf; snf--) | | |
| for (g=start_g; g<end_g; g++) | | |
| for (i=start_index[g];i<end_index[g];i++) | | |
| for (ch=0;ch<nch;ch++) { | | |
| if (cur_snf[ch][g][i]<snf) continue; | | |
| if (layer<ENHANCE_CHANNEL && ch==1) | | |
| continue; | | |
| if (!sample[ch][g][i] \|\| sign_is_ coded[ch][g][i]) | | |
| acod_sliced_bit[ch][g][i][snf]; | 0 . . . 6 | bslbf |
| if (sample[ch][g][i] && !sign_is_ coded[ch][g][i]) | | |
| { | | |
| if (layer_data_available( )) return; | | |
| acod_sign[ch][g][i]; | 1 | bslbf |
| sign_is_coded[ch][g][i]=1; | | |
| } | | |
| cur_snf[ch][g][i]--; | | |
| if (layer_data_available( )) return; | | |
| } | | |
| } | | |

Although not shown, a temporal noise shaping unit and/or a mid/side (M/S) stereo processor may be further included before the quantizer 13. The temporal noise shaping unit is used to control a temporal shape of quantization noise within each window and can perform temporal noise shaping by filtering data in frequency domain. The M/S stereo processor is used to more efficiently process a stereo signal. Based on information on a phsychoacoustic model, the M/S stereo processor converts Mid signal plus Side signal and Mid signal minus Side signal into channel 1 signal and channel 2 signal, respectively, and can determine whether to use these channel 1 and 2 signals in units of scale factor bands.

Figure 2:
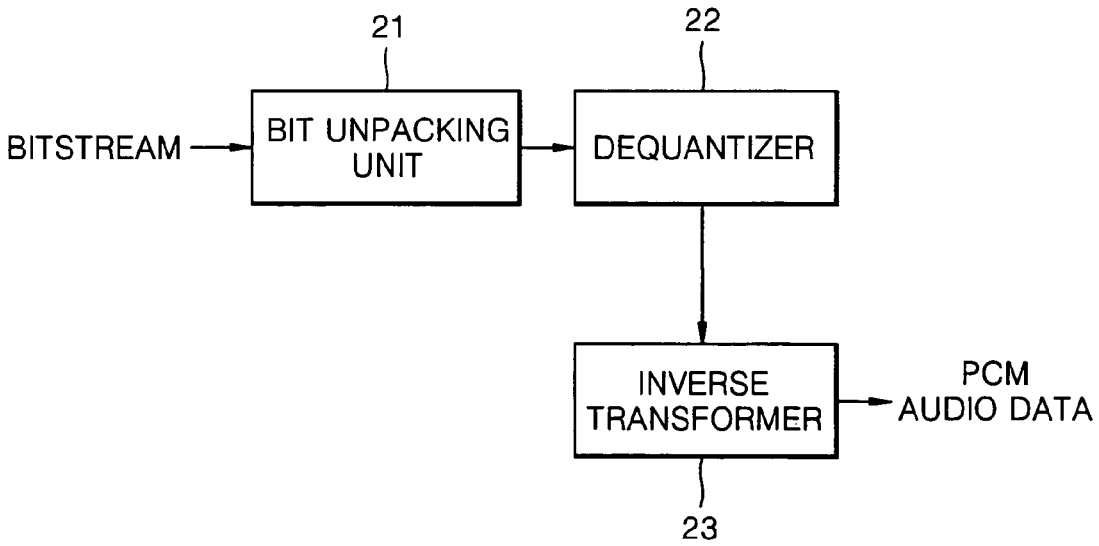
FIG. 2 is a block diagram of an audio decoding apparatus according to an embodiment of the present invention.

FIG. 2 is a block diagram of an audio decoding apparatus according to an embodiment of the present invention. The audio decoding apparatus includes a bit unpacking unit 21, a dequantizer 22, and an inverse transformer 23 to scale a bit rate by unpacking a bitstream up to a target layer determined according to a network state, performance of the audio decoding apparatus, and a user selection.

The bit unpacking unit 21 unpacks the bitstream up to the target layer and performs decoding in each layer. In other words, the bit unpacking unit 21 decodes additional information including transition point information, scale factor information, and coding model information corresponding to each layer and decodes quantized samples in each layer based on the obtained coding model information. In a stereo signal, mono components are decoded to a predetermined transition point in channel 1, and stereo components after the transition point are interleavingly decoded in channel 1 and channel 2. In the meantime, the transition point information, the quantization band information, and the coding band information can be obtained from the header information of the bitstream or obtained by decoding additional information in each layer. Alternatively, the quantization band information and the coding band information may be stored in the audio decoding apparatus in advance.

The dequantizer 22 dequantizes the decoded quantized samples in each layer according to the scale factor information corresponding to each layer to restore samples. The inverse transformer 23 transforms the restored samples from frequency to time domain and outputs PCM audio data in the time domain.

Although not shown, an M/S stereo inverse-processor and/or a temporal noise shaping unit may be further provided after the dequantizer 22. The M/S stereo inverse-processor performs a process with respect to a scale factor band that has been M/S stereo processed by an audio coding apparatus. The temporal noise shaping unit is used to control a temporal shape of quantization noise within each window and performs a process corresponding to an operation performed by a temporal noise shaping unit of the audio coding apparatus.

Figure 3:
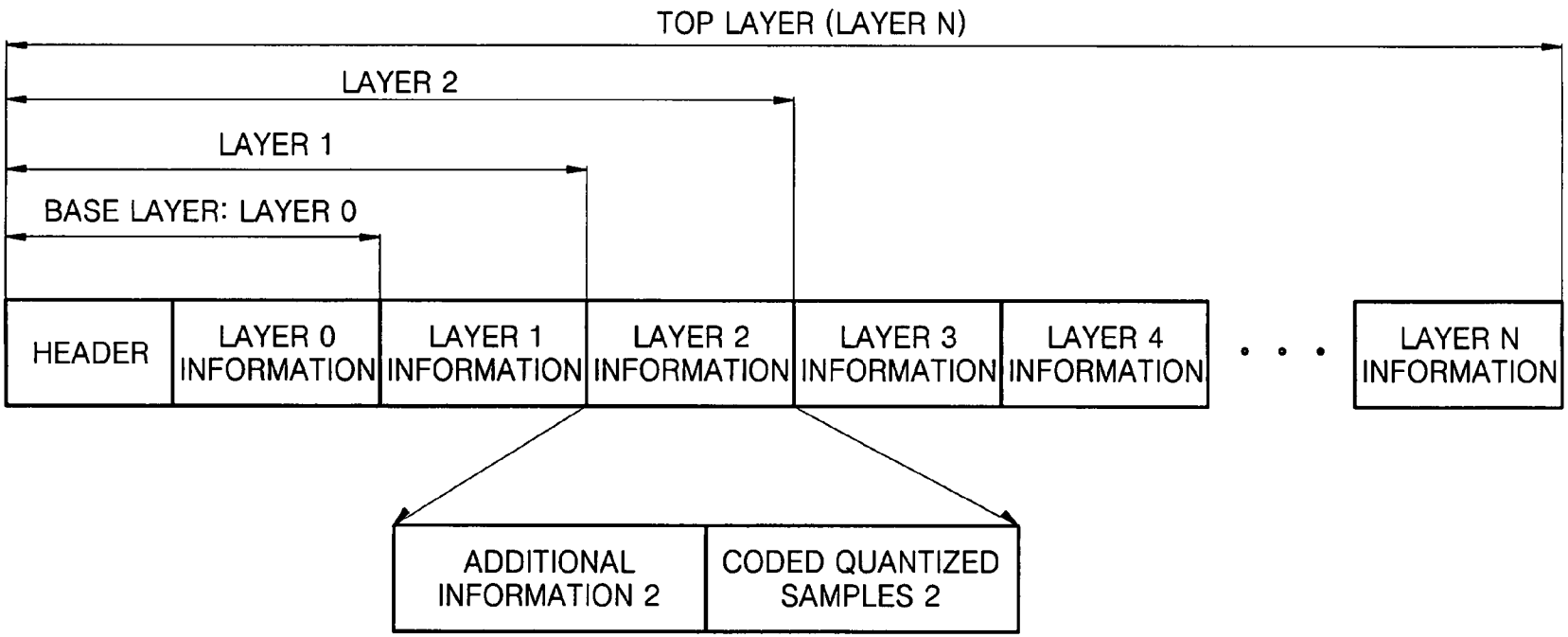
FIG. 3 is a diagram illustrating a layer architecture of a frame in a coded bitstream used in the present invention.

FIG. 3 is a diagram illustrating a structure of a frame in a bitstream which is coded in a layer architecture so that a bit rate can be scaled according to the present invention. Referring to FIG. 3, a frame in a bitstream is coded by mapping a quantization sample and additional information in a layer architecture to provide fine grain scalability (FGS). In other words, a bit stream in a lower layer is included in a bitstream in a higher layer. Additional information needed in each layer is coded in each layer.

A header area storing header information is provided at the front of the bitstream. Next to the header area, layer 0 information is packed, and then layer 1 through layer N information are sequentially packed. Layers 1 through N are referred to as enhancement layers. A range from the header area to the layer 0 information is referred to as a base layer. A range from the header area to the layer 1 information is referred to as layer 1, and a range from the header area to the layer 2 information is referred to as layer 2. Similarly, a range from the header area to layer N information is referred to as a top layer. That is, the top layer includes the base layer through enhancement layer N. Layer information includes additional information and coded audio data. For example, layer 2 information includes additional information 2 and coded quantized samples 2.

In the present invention, information on bit rates of a plurality of layers is expressed in a single bitstream so that a bitstream for a bit rate of each layer can be simply reconstructed according to a user's request or a state of a transmission line. For example, if the base layer is 16 kbps, the top layer is 96 kbps, and the enhancement layers are configured at intervals of 8 kbps, a bitstream is constructed by a coding apparatus such that information on each of layers (16, 24, 32, 40, 48, 56, 64, 72, 80, 88, and 96 kbps) is stored in a bitstream for the top layer, i.e., 96 kbps. If a user requests data for the top layer, the bitstream is transmitted without being processed. If another user requests data for the base layer, only a front part of the bitstream is clipped and transmitted.

Figure 4A:
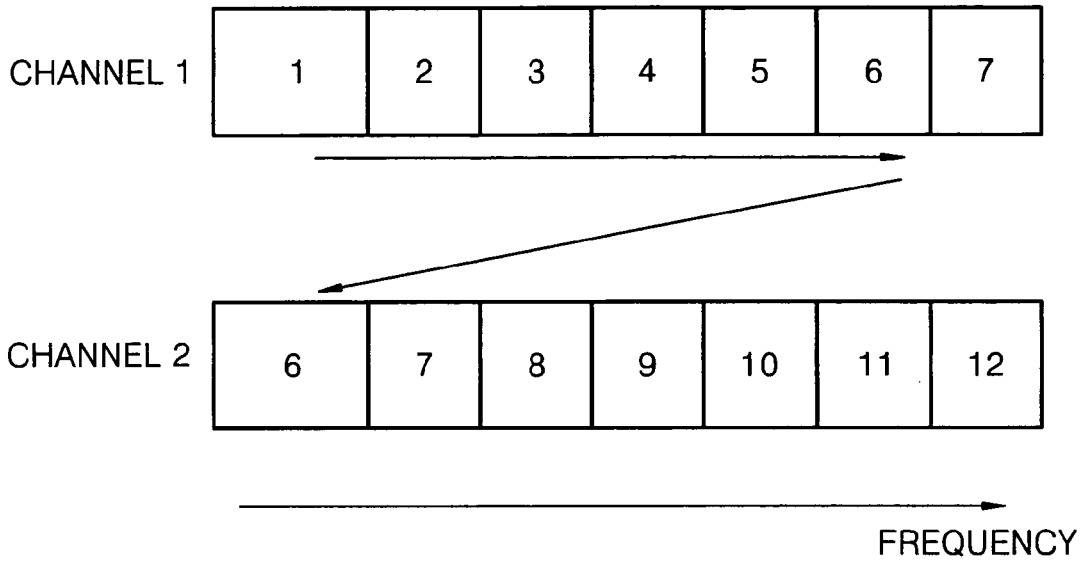
FIGS. 4A and 4B illustrate an order in which a stereo signal is coded and a coded result in the audio coding apparatus shown in FIG. 1, according to the present invention.
Figure 4B:
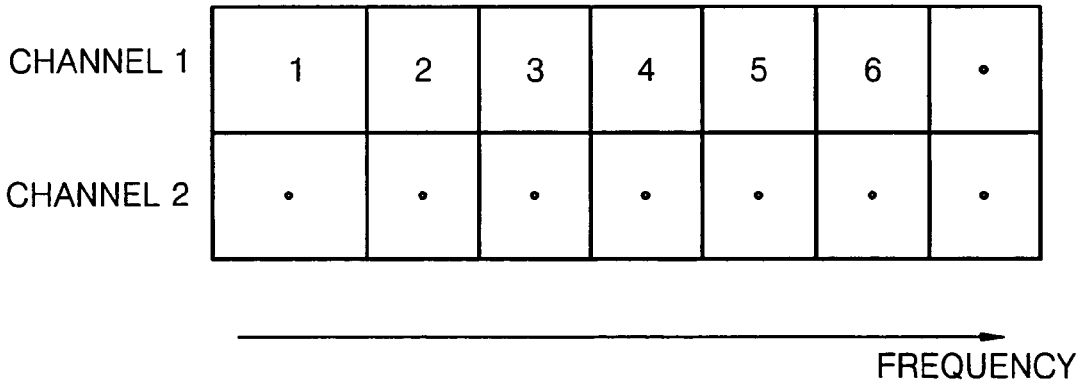

FIGS. 4A and 4B illustrate an order in which a stereo signal is coded and a coded result in the audio coding apparatus shown in FIG. 1, according to the present invention. Conventionally, as a layer index increases, channel 1 and channel 2 are alternately coded. However, in the present invention, the channel 1 is coded up to an ENHANCE_CHANNEL, for example, a fifth layer, and thereafter, the channel 1 and the channel 2 are interleavingly coded starting from a sixth layer in the channel 1. In other words, while stereo components of the channels 1 and 2 are coded up to a third layer in the conventional method, mono components of the channel 1 are coded up to a sixth layer in the present invention, during the same period.

Based on the above-described structure, a stereo audio coding and decoding method according to embodiments of the present invention will be described below.

Figure 5:
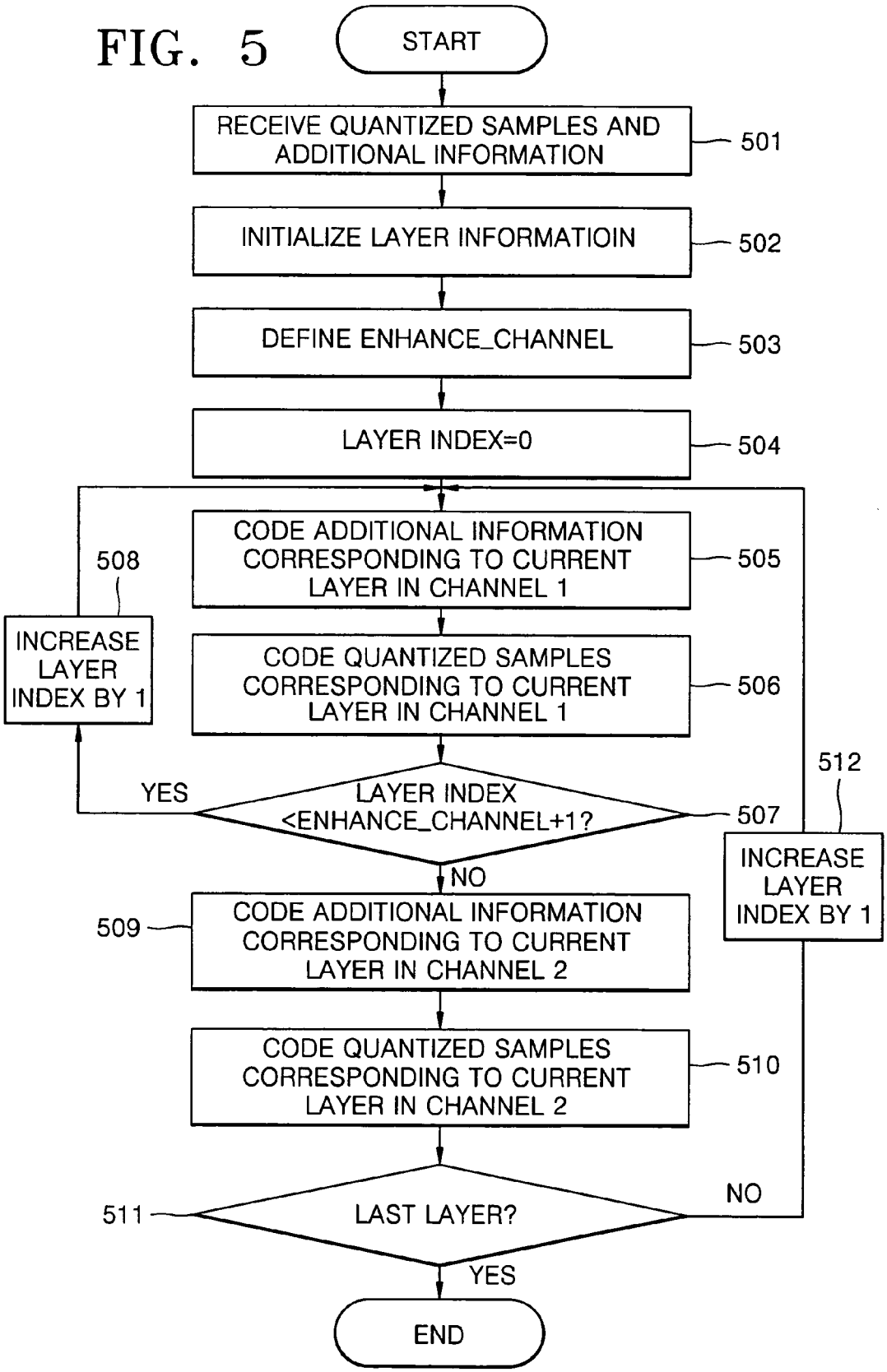
FIG. 5 is a flowchart of an audio coding method according to an embodiment of the present invention.

FIG. 5 is a flowchart of an audio coding method according to an embodiment of the present invention. The audio coding method includes receiving additional information and quantized samples in operations 501 and 502, defining an ENHANCE_CHANNEL in operation 503, coding mono components in operations 504 through 508, and coding stereo components in operations 505 through 512. In the embodiment shown in FIG. 5, a layer index is set as a transition point, and for clarity of the description, the transition point is referred to as an ENHANCE_CHANNEL.

Referring to FIG. 5, the bit packing unit 14 receives quantized samples and additional information from the quantizer 13 in operation 501 and obtains layer information in operation 502. In other words, layer information such as a frequency bandwidth of each layer, the number of bits that can be used in each layer, and a quantization band and coding band corresponding to each layer is obtained using a sampling rate of the received audio samples, a target bit rate, a cutoff frequency in a top layer, a coding band length, a quantization band unit, and the desired number of layers.

In operation 503, ENHANCE_CHANNEL information is defined. The ENHANCE_CHANNEL information indicates an index of a layer where transition is made from mono component coding to stereo component coding in channel 1. For example, when a bit rate of 16-64 Kbps is provided and a bit rate interval between layers is set to 1 Kbps, layer 0 through layer 47 can be generated. In this situation, the ENHANCE_CHANNEL information can be expressed using 6 or less bits. The value of the ENHANCE_CHANNEL information is determined according to which of stability of sound quality and a stereo characteristic will be enhanced. In other words, when the index of an ENHANCE_CHANNEL has a large value, stability of sound quality is more enhanced than a stereo characteristic in a lower layer. Conversely, when the index of an ENHANCE_CHANNEL has a small value, a stereo characteristic is more enhanced than stability of sound quality in a lower layer.

The layer index is set to "0" in operation 504. Additional information corresponding to layer 0 is coded with respect to the channel 1 of the stereo channels in operation 505. Quantized samples corresponding to the layer 0 are coded with respect to the channel 1 in operation 506.

The current layer index is compared with the ENHANCE_CHANNEL information in operation 507. When the current layer index is less than a value obtained by adding 1 to a layer index indicated by the ENHANCE_CHANNEL information, the current layer index is increased by 1 in operation 508, and the coding operation returns to operation 505. Meanwhile, when the current layer index is equal to or greater than the value obtained by adding 1 to the layer index indicated by the ENHANCE_CHANNEL information, the coding operation goes to operation 509.

Additional information corresponding to the layer 0 is coded with respect to channel 2 of the stereo channels in operation 509. Quantized samples corresponding to the layer 0 are coded with respect to the channel 2 in operation 510.

It is determined whether the current layer index is a last layer index, that is, a target layer index in operation 511. When the current layer index is not the last layer index, the current layer index is increased by 1 in operation 512, and the coding operation returns to operation 505. Meanwhile, when the current layer index is the last layer index, the coding operation ends.

Figure 6:
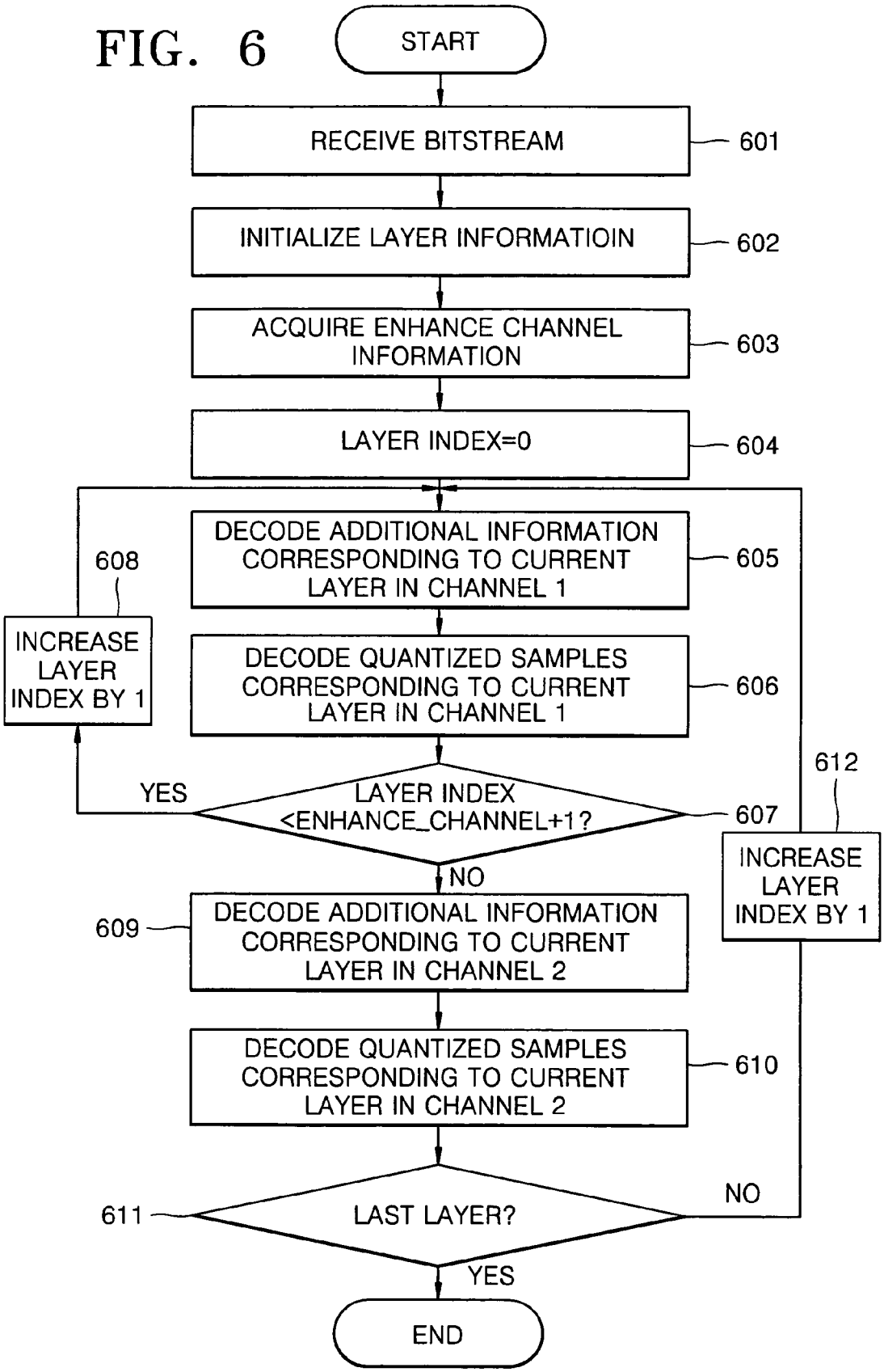
FIG. 6 is a flowchart of an audio decoding method according to an embodiment of the present invention.

FIG. 6 is a flowchart of an audio decoding method according to an embodiment of the present invention. The audio decoding method includes receiving a bitstream in operations 601 and 602, acquiring ENHANCE_CHANNEL information in operation 603, decoding mono components in operations 604 through 608, and decoding stereo components in operations 605 through 612.

Referring to FIG. 6, the bit unpacking unit 21 receives a bitstream in operation 601 and obtains layer information in operation 602. The layer information can be obtained in the same manner as used in operation 502 shown in FIG. 5.

In operation 603, header information is extracted from a header area in the bitstream, and ENHANCE_CHANNEL information is acquired from the header information.

A layer index is set to "0" in operation 604. Additional information corresponding to layer 0 is extracted from the bitstream with respect to channel 1 among stereo channels and is decoded in operation 605. Quantized samples corresponding to the layer 0 are extracted from the bitstream with respect to the channel 1 and are decoded in operation 606.

The current layer index is compared with the ENHANCE_CHANNEL information in operation 607. When the current layer index is less than a value obtained by adding 1 to a layer index indicated by the ENHANCE_CHANNEL information, the current layer index is increased by 1 in operation 608, and the decoding operation returns to operation 605. Meanwhile, when the current layer index is equal to or greater than the value obtained by adding 1 to the layer index indicated by the ENHANCE_CHANNEL information, the decoding operation goes to operation 609.

Additional information corresponding to layer 0 is extracted from the bitstream with respect to channel 2 among the stereo channels and is decoded in operation 609. Quantized samples corresponding to the layer 0 are extracted from the bitstream with respect to the channel 2 and are decoded in operation 610.

It is determined whether the current layer index is a last layer index, that is, a target layer index in operation 611. If the current layer index is not the last layer index, the current layer index is increased by 1 in operation 612, and the decoding operation returns to operation 605. Meanwhile, when the current layer index is the last layer index, the decoding operation ends.

Figure 7A:
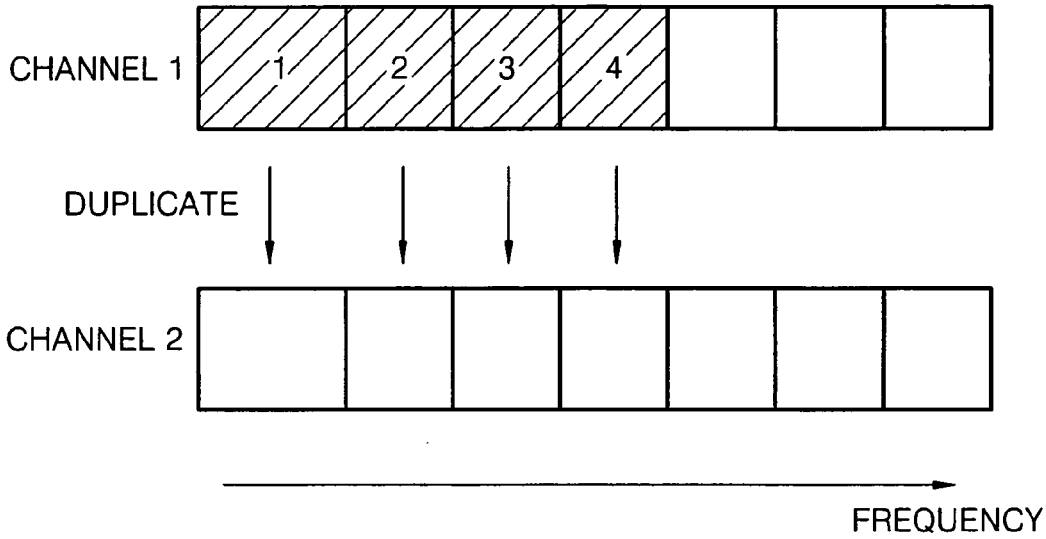
FIGS. 7A and 7B illustrate audio decoding methods according to other embodiments of the present invention.
Figure 7B:
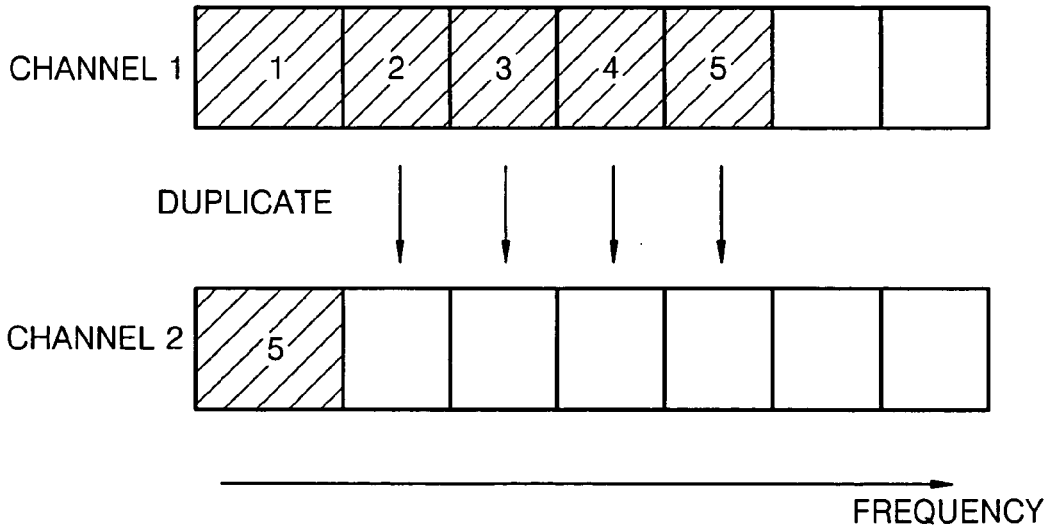

FIGS. 7A and 7B illustrate audio decoding methods according to other embodiments of the present invention.

Referring to FIG. 7A, when decoding is interrupted at a layer, e.g., a fourth layer, in the middle of channel 1, there is no data decoded in channel 2 even through a stereo signal is being decoded. In this situation, decoding is performed by duplicating quantized samples and additional information that have been decoded in first through fourth layers of the channel 1 to first through fourth layers of the channel 2.

Meanwhile, referring to FIG. 7B, when decoding is interrupted at a lower layer of the channel 2 after decoding is completed up to an ENHANCE_CHANNEL of the channel 1, the decoded left and right spectrum widths differ each other. To compensate this, decoding is performed by duplicating quantized samples and additional information that have been decoded in the second through fourth layers of the channel 1 to the second through fourth layers of the channel 2.

In the above-described embodiments, mono audio coding of a typical BSAC technology may be employed for mono components up to the transition layer and stereo audio coding of the BSAC technology may be employed for stereo components from a layer after the transition layer.

The present invention can be realized as a code which is recorded on a computer readable recording medium and can be read by a computer. The computer readable recording medium may be any type of medium on which data which can be read by a computer system can be recorded, for example, a ROM, a RAM, a CD-ROM, a magnetic tape, a floppy disc, or an optical data storage device. The present invention can also be realized as a firmware. Alternatively, the present invention can be realized as a code which is stored in the recording media and can be read and executed in the computers. Functional programs, codes, and code segments for implementing the present invention can be easily inferred by programmers in the field of the invention.

According to the present invention, when a stereo audio signal is coded, an audio signal of channel 1 is coded first up to an ENHANCE_CHANNEL, and then the audio signal of the channel 1 and an audio signal of channel 2 are interleavingly coded, thereby increasing sound quality in a lower layer while providing FGS.

In the drawings and specification, preferred embodiments of the invention have been described using specific terms, but it is to be understood that such terms have been used only in a descriptive sense and such descriptive terms should not be construed as placing any limitation on the scope of the invention. Accordingly, it will be apparent to those of ordinary skill in the art that various changes can be made to the embodiments without departing from the scope and spirit of the invention. Therefore, the scope of the invention is defined by the appended claims.

What is claimed is:

1. A scalable stereo audio coding method comprising:

transforming a first channel and a second channel audio samples;

quantizing the transformed first channel and the second channel audio samples; and coding only the channel audio samples of one of the quantized first channel audio samples and the quantized second channel audio samples as a mono signal commencing at a base layer and continuing up to a predetermined transition layer having a layer index greater than one and then interleavingly coding the quantized first and second channel audio samples as a stereo signal by increasing a layer index from a layer succeeding the transition layer, until coding for a predetermined plurality of layers is finished.

2. The scalable stereo audio coding method of claim 1 further comprising transforming a Mid signal and a Side signal of the transformed first channel and second channel audio samples to the first channel and the second channel audio samples, respectively, before quantizing.

3. The scalable stereo audio coding method of claim 1, wherein the transition layer is determined according to which of sound quality and a stereo characteristic is enhanced.

4. The scalable stereo audio coding method of claim 1, wherein information of the transition layer is expressed as one selected from the group consisting of a layer index, a scale factor band, and a coding band.

5. The scalable stereo audio coding method of claim 3, wherein information of the transition layer is included in one of header information and additional information of a hierarchical bitstream.

6. A scalable stereo audio coding apparatus comprising:

a computer;

a psychoacoustic unit providing information on a psychoacoustic model;

a transformation unit transforming a first channel and a second channel audio samples based on the information on a psychoacoustic model;

a quantizer quantizing the transformed first channel and a second channel audio samples; and a bit packing unit coding only the channel audio samples of one of the quantized first channel audio samples and the quantized second channel audio samples as a mono signal commencing at a base layer and continuing up to a predetermined transition layer having a layer index greater than one and then interleavingly coding the quantized first and second channel audio samples as a stereo signal by increasing a layer index from a layer succeeding the transition layer, until coding for a predetermined plurality of layers is finished.

7. The scalable stereo audio coding apparatus of claim 6 further comprising a M/S stereo processor transforming a Mid signal and a Side signal of the transformed first channel and second channel audio samples to the first channel and the second channel audio samples, respectively to then be supplied to the quantizer.

8. The scalable stereo audio coding apparatus of claim 6, wherein the transition layer is determined according to which of sound quality and a stereo characteristic is enhanced.

9. The scalable stereo audio coding apparatus of claim 6, wherein information of the transition layer is expressed as one selected from the group consisting of a layer index, a scale factor band, and a coding band.

10. The scalable stereo audio coding apparatus of claim 6, wherein information of the transition point is included in one of header information and additional information of the hierarchical bitstream.

11. A scalable stereo audio decoding method comprising:

decoding only the channel audio samples of one of a first channel audio samples and second channel audio samples as a mono signal from a base layer up to a predetermined transition layer having a layer index greater than one and then interleavingly decoding the first and a second channel audio samples as a stereo signal by increasing a layer index from a layer succeeding the transition layer, until decoding for a predetermined plurality of layers is finished and obtaining quantized samples of the first and the second channels;

dequantizing the quantized samples of the first and the second channels; and inverse transforming the dequantized samples of the first and the second channels to obtain first and the second channel audio samples.

12. The scalable stereo audio decoding method of claim 11, wherein in interleavingly decoding the first and a second channel audio samples, when decoding is interrupted from a layer succeeding the predetermined transition layer, duplicating quantized samples, which have been decoded in the first channel, to correspondent layers of the second channel, thereby restoring the quantized samples.

13. The scalable stereo audio decoding method of claim 11, wherein in interleavingly decoding the first and a second channel audio samples, when decoding is interrupted at a certain layer in the second channel, duplicating quantized samples, which have been decoded from the certain layer of the first channel, to correspondent layers of the second channel, thereby restoring the quantized samples.

14. The scalable stereo audio decoding method of claim 11 further comprising M/S stereo inverse-processing the dequantized samples of the first and the second channels.

15. The scalable stereo audio decoding method of claim 11, wherein information of the transition layer is obtained as one selected from the group consisting of a layer index, a scale factor band, and a coding band.

16. The scalable stereo audio decoding method of claim 11, wherein information of the transition layer is extracted from one of header information and additional information of the bitstream having a layered architecture.

17. A scalable stereo audio decoding apparatus comprising:

a computer;

a bit unpacking unit decoding only the channel audio samples of one of a first channel audio samples and a second channel audio samples as a mono signal from a base layer up to a predetermined transition layer having a layer index greater than one and then interleavingly decoding the first and a second channel audio samples as a stereo signal by increasing a layer index from a layer succeeding the transition layer, until decoding for a predetermined plurality of layers is finished and obtaining quantized samples of the first and the second channels;

dequantizer dequantizing the quantized samples of the first and the second channels; and inverse transformer inverse transforming the dequantized samples of the first and the second channels to obtain first and the second channel audio samples.

18. The scalable stereo audio decoding apparatus of claim 17, wherein when decoding is interrupted from a layer succeeding the predetermined transition layer, the bit unpacking unit duplicates quantized samples which have been decoded in the first channel, to correspondent layers of the second channel, thereby restoring the quantized samples.

19. The scalable stereo audio decoding apparatus of claim 17, wherein when decoding is interrupted at a certain layer in the second channel, the bit unpacking unit duplicates quantized samples which have been decoded from the certain layer of the first channel, to correspondent layers of the second channel, thereby restoring the quantized samples.

20. The scalable stereo audio decoding apparatus of claim 17 further comprising M/S stereo inverse-processor M/S stereo inverse-processing the dequantized samples of the first and the second channels.

21. A non-transitory computer readable recording medium having recorded thereon a program for executing the scalable stereo audio coding method of claim 1.

22. A non-transitory computer readable recording medium having recorded thereon a program for executing the scalable stereo audio decoding method of claim 11.

* * * * *

UNITED STATES PATENT AND TRADEMARK OFFICE

CERTIFICATE OF CORRECTION

PATENT NO. : 7,835,915 B2
APPLICATION NO. : 10/737957
DATED : November 16, 2010
INVENTOR(S) : Jung-Hoe Kim et al.

It is certified that error appears in the above-identified patent and that said Letters Patent is hereby corrected as shown below:

Title Page Column 2 (Foreign Patent Documents), Line 2 delete "P1998-076475" and insert -- P1998-079475 --, therefor.

Signed and Sealed this
Twenty-second Day of February, 2011

David J. Kappos

David J. Kappos
*Director of the United States Patent and Trademark Office*